US005613987A

United States Patent [19]

Kuroki et al.

[11] Patent Number: 5,613,987

[45] Date of Patent: Mar. 25, 1997

[54] COLORED HIGH-TENACITY FILAMENTS OF POLYETHYLENE AND PROCESS FOR THEIR PRODUCTION

[75] Inventors: Tadao Kuroki; Yasuo Ota, both of Otsu, Japan

[73] Assignee: Toyo Boseki Kabushiki Kaisha, Osaka, Japan

[21] Appl. No.: 466,823

[22] Filed: Jun. 6, 1995

Related U.S. Application Data

[63] Continuation of Ser. No. 86,706, Jul. 7, 1993, abandoned.

[30] Foreign Application Priority Data

Oct. 7, 1992 [JP] Japan ..... 4-183791

[51] Int. Cl.[6] ..... D06P 3/79

[52] U.S. Cl. ..... 8/513; 8/538; 8/928; 524/484; 524/485

[58] Field of Search ..... 524/484, 485; 8/513, 538, 928

[56] References Cited

U.S. PATENT DOCUMENTS 3,882,095 5/1975 Fowells et al. ..... 526/169.2

*Primary Examiner*—Peter D. Mulcahy

*Attorney, Agent, or Firm*—Foley & Lardner

[57] ABSTRACT

There is disclosed a colored high-tenacity fiber of ultra-high molecular weight polyethylene which is obtainable by spinning a solution of ultra-high molecular weight polyethylene and a dye for coloration to form solvent-containing filaments and drawing the solvent-containing filaments. The colored high-tenacity fiber of ultra-high molecular weight polyethylene has a tensile strength of at least 28 g/d and a tensile modulus of at least 700 g/d. The dye is substantially soluble in the solvent at the melting point of solvent-containing filaments which are obtained by spinning a solution of ultra-high molecular weight polyethylene and the dye is substantially uniformly dispersed in the core portion of the fiber. Also disclosed is a process for producing a colored high-tenacity fiber of ultra-high molecular weight polyethylene.

21 Claims, No Drawings

COLORED HIGH-TENACITY FILAMENTS OF POLYETHYLENE AND PROCESS FOR THEIR PRODUCTION

This application is a continuation, of application Ser. No. 08/086,706, filed Jul. 7, 1993 abandoned.

FIELD OF THE INVENTION

The present invention relates to a colored high-tenacity fiber, and more particularly, it relates to a colored high-tenacity fiber of ultra-high molecular weight polyethylene. The present invention also relates to a process for producing a colored high-tenacity fiber of ultra-high molecular weight polyethylene.

BACKGROUND OF THE INVENTION

As a process for production of colored fibers, there has hitherto been known a spinning technique in which a raw material polymer is mixed with various dyes, pigments or inorganic compounds such as carbon black and titanium oxide. This technique is widely employed as the so-called "mass coloration". Alternatively, colored fibers can also be obtained by various conventional staining techniques after the formation of fibers.

In cases where mass coloration is employed for production of ultra-high molecular weight polyethylene fibers, various additives such as inorganic compounds are added to a solution of the raw material polymer, and these additives act as defects in the crystallization of ultra-high molecular weight polyethylene for development of high tenacity, thereby causing adverse effects such as tenacity lowering. To avoid such a problem, fine particles of inorganic compounds or organic pigments may be used for mass coloration. In general, however, fine particles have a particle size distribution which may usually include the range of particular particle sizes becoming defects, and the use of fine particles having a uniform particle size is disadvantageous in most cases from an economical point of view. Moreover, when fine particles of pigments are used, filter clogging and fiber breaking will occur in the spinning step, which is not fit for continuous operation.

In cases where a staining technique after the fiber formation is employed for production of colored high-tenacity fibers of ultra-high molecular weight polyethylene, it is difficult to achieve staining with sufficient fastness because polyethylene has a simple chemical structure and extremely high crystallinity.

SUMMARY OF THE INVENTION

Under these circumstances, the present inventors have intensively studied to develop a process for producing a colored high-tenacity fiber of polyethylene. As the result, they have found that colored high-tenacity fibers can be produced, while maintaining sufficiently high tensile strength and high tensile modulus, from ultra-high molecular weight polyethylene by addition of a particular dye to a solution of that raw material polymer under particular conditions, thereby completing the present invention.

That is, the present invention provides a colored high-tenacity fiber of ultra-high molecular weight polyethylene which is obtainable by spinning a solution of ultra-high molecular weight polyethylene and a dye for coloration to form solvent-containing filaments and drawing the solvent-containing filaments. The colored high-tenacity fiber of ultra-high molecular weight polyethylene has a tensile strength of at least 28 g/d and a tensile modulus of at least 700 g/d. The dye is substantially soluble in the solvent at the melting point of solvent-containing filaments which are obtained by spinning a solution of ultra-high molecular weight polyethylene and the dye is substantially uniformly dispersed in the core portion of the colored high-tenacity fiber.

Also provided is a process for producing a colored high-tenacity fiber of ultra-high molecular weight polyethylene, comprising the steps of: (a) preparing a solution of ultra-high molecular weight polyethylene in a solvent; b) adding a dye for coloration to the solution at an amount below the solubility of the dye in the solvent at the melting temperature of solvent-containing filaments which are obtained by spinning the solution of ultra-high molecular weight polyethylene; (c) spinning the solution of ultra-high molecular weight polyethylene containing the dye to form solvent-containing filaments; and (d) drawing the solvent-containing filaments to form a colored high-tenacity fiber of ultra-high molecular weight polyethylene. Alternatively, a dye for coloration as described above may be mixed with ultra-high molecular weight polyethylene in a solvent to form a spinning solution, which is then subjected to spinning and drawing, thereby obtaining a colored high-tenacity fiber of ultra-high molecular weight polyethylene.

DETAILED DESCRIPTION OF THE INVENTION

The colored high-tenacity fiber of ultra-high molecular weight polyethylene according to the present invention is characterized in that it contains a dye for coloration which is substantially soluble in a solvent as used for preparing a solution of ultra-high molecular weight polyethylene at the melting point of solvent-containing filaments obtained by spinning the solution of ultra-high molecular weight polyethylene and which is substantially uniformly dispersed in the core portion thereof, so that it has sufficient fastness to abrasion as well as to the solvent, while maintaining sufficiently high tensile strength and high tensile modulus.

As used herein, the term "ultra-high molecular weight polyethylene" refers to ethylene homopolymer and any copolymer of ethylene with other copolymerizable monomers such as α-olefins (e.g., propylene, butylene, pentene, hexene, 4-methylpentene, octene) and acrylic esters (e.g., esters of acrylic acid, methacrylic acid, chloroacrylic acid). Also included is a blend of ethylene homopolymer and any copolymer of this type. The viscosity-average molecular weight thereof is usually at least 500,000, preferably at least 1,000,000, and more preferably at least 1,500,000. Smaller molecular weights are disadvantageous for development of high tenacity.

The solvent for preparing a solution of ultra-high molecular weight polyethylene is not particularly limited. Examples thereof are aliphatic and alicyclic hydrocarbons such as octane, nonane, decane and paraffins, including isomers thereof; petroleum fractions; aromatic hydrocarbons such as toluene, xylene and naphthalene, including hydrogenated derivatives thereof, such as decalin and tetralin; and halogenated hydrocarbons such as monochlorobenzene.

As the process for producing a high-tenacity polyethylene fiber, there have hitherto been known various procedures in which a solution of ultra-high molecular weight polyethylene in an appropriate solvent is spun to form solvent-containing filaments which are then drawn at a particular draw ratio to produce a high-tenacity polyethylene fiber, such as described in JP-A 55-107506 and JP-A 56-15408. In the process of the present invention, colored high-tenacity fibers of ultra-high molecular weight polyethylene may be produced substantially in accordance with the procedures as described in the above publications.

The process for producing a colored high-tenacity fiber of ultra-high molecular weight polyethylene according to the present invention is characterized in that a dye for coloration which is substantially soluble in a solvent used for preparing a solution of ultra-high molecular weight polyethylene at the melting temperature of solvent-containing filaments which are obtained by spinning a solution of ultra-high molecular weight polyethylene is added to the solution of ultra-high molecular weight polyethylene at an amount below the solubility thereof in the solvent at the melting temperature of solvent-containing filaments. Alternatively, a dye for coloration as described above may be mixed with ultra-high molecular weight polyethylene in a solvent to form a spinning solution. The subsequent spinning and drawing steps are substantially the same as those employed in any conventional process for producing a high-tenacity polyethylene fiber.

The following will further describe the process for producing a colored high-tenacity fiber of ultra-high molecular weight polyethylene.

As used herein, the term "solvent-containing filaments obtained by spinning a solution of ultra-high molecular weight polyethylene" refers to gel-like filaments containing a solvent used for preparing a solution of ultra-high molecular weight polyethylene, which are obtained by extruding the solution from a spinneret and then allowing to pass through a cooling zone. The melting temperature thereof is determined as a peak temperature of its endothermic curve in the differential scanning colorimetry (DSC). The solubility of a dye for coloration is then determined with respect to the solvent used for preparing a solution of ultra-high molecular weight polyethylene at the melting temperature of solvent-containing filaments.

The dye for coloration is added to the solution of ultra-high molecular weight polyethylene at an amount below the solubility as determined above, thereby obtaining a spinning solution. The spinning solution is then subjected to spinning and drawing, resulting in a colored high-tenacity fiber of ultra-high molecular weight polyethylene. The addition of a dye may be conducted at the stage before the step of uniformly dissolving a raw material polymer, during the dissolution step, or after the dissolution step but before the spinning, with the proviso that sufficient time for providing a uniform dispersion of the dye is ensured. As described above, the subsequent spinning and drawing may be conducted by any steps are substantially the same as those employed in any conventional process for producing a high-tenacity polyethylene fiber.

The dye which is substantially soluble in a solvent used for preparing a solution of ultra-high molecular weight polyethylene is not particularly limited. Examples thereof are oil dyes such as Solvent Yellow 16, Solvent Yellow 56, Solvent Black 7, Solvent Red 4, Solvent Blue 14, Solvent Blue 25, Solvent Green 28 and Solvent Violet 13; disperse dyes such as Disperse Violet 31 and Disperse Yellow 64; and various basic dyes and acid dyes which can be dissolved in the above solvent. These dyes may be used solely or in combination.

The colored high-tenacity fibers of the present invention are characterized in that these fibers, although they are produced using a solvent-soluble dye, have sufficient fastness to that solvent for practical applications. In other words, because a dye which is substantially soluble in a solvent at the melting point of solvent-containing filaments obtained from a solution of ultra-high molecular weight polyethylene is used for the production of colored high-tenacity fibers of polyethylene, dye separation is effectively suppressed in the formation of fibers, so that the dye molecules are not only dispersed in the fibers, in particular, uniformly dispersed in the core portion thereof, but also entrapped into the fiber with the aid of their high crystallinity. For this reason, the colored high-tenacity fibers of the present invention can attain the above-described excellent advantages. Moreover, the colored high-tenacity fibers of the present invention have extremely excellent fastness to abrasion as compared with conventional colored high-tenacity fibers which are simply obtained by staining high-tenacity polyethylene fibers.

The present invention will be further illustrated by way of the following example and comparative examples, which are not to be construed to limit the scope thereof.

Measurement

The following will describe various measurement methods and their conditions which were employed in the example and comparative examples.

(1) Viscosity-Average Molecular Weight

The intrinsic viscosity ($\eta$) of a polyethylene solution was measured at 135° C. in decalin by means of a capillary viscometer. The viscosity-average molecular weight ($M_V$) of polyethylene was calculated from the intrinsic viscosity ($\eta$) using the following equation:

$$M_V=5.37\times10^4[\eta]^{1.37}$$

(2) Measurement of Tenacity (Tensile Strength and Tensile Modulus)

A sample fiber was subjected to the tensile test according to the procedures of JIS L-1013 (1981). The tensile test was carried out using a tensile tester (Orientec) under the conditions that the sample length was 200 mm and the stress rate was 100 mm/min., thereby obtaining a stress vs. strain curve (hereinafter referred to as S—S curve). The tensile strength at break and tensile modulus were evaluated from the S—S curve. More particularly, the tensile modulus was calculated from the maximum gradient around the origin of the S—S curve.

(3) Differential Scanning Calorimetry (DSC)

Using a differential scanning calorimeter (Rigaku), the melting point of solvent-containing filaments was determined. The filaments of 10 mg in weight were put into a high-pressure sample vessel and subjected to the measurement. The sample temperature was raised from room temperature to 150° C. at a rate of 10° C./min., and the maximum of the melting peak was regard as the melting point of the solvent-containing filaments.

(4) Fastness to Abrasion

The fastness to abrasion was determined both in dry state and in wet state by means of an abrasion tester of type II according to the procedures of JIS L-0849.

(5) Solubility

An appropriate amount of dye used was mixed in 100 g of a solvent used for preparing a solution of ultra-high molecular weight polyethylene. At the melting temperature of solvent-containing filaments which had been previously determined, the mixture was stirred for 1 hour, and then filtered through a glass filter. The residue (i.e., undissolved dye) remaining on the glass filter was weighed, and the solubility was calculated from its weight.

EXAMPLE 1

First, 10% by weight of polyethylene having a viscosity-average molecular weight of 2,900,000 was mixed with 90% by weight of decahydronaphthalene, and with a selected dye (referred to as Solvent Green 28 by its color index name; anthraquinone derivative dye) at an amount of 0.05% by weight, based on the weight of decahydronaphthalene. The mixture was well kneaded in a screw extruder at 180°–220° C. to form a solution of ultra-high molecular weight polyethylene. The resulting solution was then extruded through an orifice of 0.5 mm in diameter while taking off the solvent-containing filaments at a rate of 50 m/min. The solvent-containing filaments thus obtained were then drawn at a draw ratio of 3 times in an oven under heated air at 100° C. The partially-oriented filaments were further drawn at a draw ratio of 5 times to give colored high-tenacity fibers of polyethylene. The tensile strength and tensile modulus of the fibers were determined to be 43 g/d and 1550 g/d, respectively. Moreover, the colored high-tenacity fibers of this example were excellent in fastness to abrasion which was determined to be from the forth to the fifth grade both in dry state and in wet state.

The melting point of solvent-containing filaments obtained without addition of any dye was 102° C. In addition, the solubility of the dye (Solvent Green 28) in 100 g of decahydronaphthalene at 102° C. was not less than 0.05 g.

COMPARATIVE EXAMPLE 1

Colored high-tenacity fibers of polyethylene were produced in the same manner as described in Example 1, except that carbon black was used as a dye at an amount of 0.1% by weight, in place of Solvent Green 28. The tensile strength of the fibers was 35 g/d, which was comparable to that of Example 1; however, these fibers were not satisfactory from an operational point of view because of an increase in the back pressure of the nozzle filter and a frequent occurrence of fiber breaking. This is because carbon black used as a dye was almost insoluble in decahydronaphthalene.

COMPARATIVE EXAMPLE 2

Colored polyethylene fibers were produced in the same manner as described in Example 1, except that malachite green oxalate (Merck) was used as a dye at an amount of 0.05% by weight, in place of Solvent Green 28. The tensile strength of the fibers was 23 g/d, which was inferior to that of Example 1.

The solubility of malachite green oxalate in 100 g of decahydronaphthalene at 102° C. was less than 0.01 g, and this dye was almost insoluble in decahydronaphtalene.

COMPARATIVE EXAMPLE 3

High-tenacity polyethylene fibers having a tensile strength of 40 g/d were immersed in a solution of Solvent Green 28 in decahydronaphthalene at 60° C. for 1 hour, thereby obtaining colored high-tenacity fibers of polyethylene. The fastness to abrasion of the fibers was the first grade, which was extremely inferior to that of Example 1.

COMPARATIVE EXAMPLE 4

Colored high-tenacity fibers of polyethylene were produced in the same manner as described in Example 1, except that Pigment Blue 15 was used as a dye at an amount of 0.05% by weight, in place of Solvent Green 28. The tensile strength of the fibers was 34 g/d, which was comparable to that of Example 1; however, these fibers were not satisfactory from an operational point of view because of an increase in the back pressure of the nozzle filter and a frequent occurrence of fiber breaking. This is because Pigment Blue 15 used as a dye was almost insoluble in decahydronaphthalene.

What is claimed is:

1. A colored filament of ultra-high molecular weight polyethylene which is obtained by spinning a solution of ultra-high molecular weight polyethylene in a solvent and a dye for coloration to form solvent-containing filaments and drawing the solvent-containing filaments, wherein said colored filament has a tensile strength of at least 28 g/d and a tensile modulus of at least 700 g/d, said dye is substantially uniformly dispersed in the core portion of said colored filament, and said dye is substantially soluble in said solvent at the melting point of said solvent-containing filaments.

2. A colored filament of ultra-high molecular weight polyethylene according to claim 1, wherein the viscosity-average molecular weight of said polyethylene is at least 500,000.

3. A colored filament of ultra-high molecular weight polyethylene according to claim 2, wherein the viscosity-average molecular weight of said polyethylene is at least 1,000,000.

4. A colored filament of ultra-high molecular weight polyethylene according to claim 1, which has a tensile strength of at least 35 g/d and a tensile modulus of at least 1150 g/d.

5. A colored filament of ultra-high molecular weight polyethylene according to claim 4, which has a tensile strength of at least 40 g/d and a tensile modulus of at least 1250 g/d.

6. A colored filament of ultra-high molecular weight polyethylene according to claim 1, wherein said dye is selected from the group consisting of solvent dyes and disperse dyes.

7. A colored filament of ultra-high molecular weight polyethylene according to claim 6, wherein said dye is an anthraquinone derivative dye.

8. A process for producing a colored filament of ultra-high molecular weight polyethylene having a tensile strength of at least 28 g/d and a tensile modulus of at least 700 g/d, comprising the steps of:

(a) preparing a solution of ultra-high molecular weight polyethylene having a tensile strength of at least 28 g/d and a tensile modulus of at least 700 g/d in a solvent;

(b) adding a dye for coloration to said solution at an amount below the solubility of said dye in said solvent at the melting temperature of solvent-containing filaments which are obtained by spinning said solution of ultra-high molecular weight polyethylene;

(c) spinning said solution of ultra-high molecular weight polyethylene containing said dye to form solvent-containing filaments; and (d) drawing said solvent-containing filaments to form a colored filament of ultra-high molecular weight polyethylene.

9. A process according to claim 8, wherein the viscosity-average molecular weight of said polyethylene is at least 500,000.

10. A process according to claim 9, wherein the viscosity-average molecular weight of said polyethylene is at least 1,000,000.

11. A process according to claim 8, wherein said colored filament of ultra-high molecular weight polyethylene has a tensile strength of at least 35 g/d and a tensile modulus of at least 1150 g/d.

12. A process according to claim 11, wherein said colored filament of ultra-high molecular weight polyethylene has a tensile strength of at least 40 g/d and a tensile modulus of at least 1250 g/d.

13. A process according to claim 8, wherein said dye is selected from the group consisting of solvent dyes and disperse dyes.

14. A process according to claim 13, wherein said dye is an anthraquinone derivative dye.

15. A process for producing a colored filament of ultra-high molecular weight polyethylene having a tensile strength of at least 28 g/d and a tensile modulus of at least 700 g/d, comprising the steps of:

(a) preparing a solution of ultra-high molecular weight polyethylene having a tensile strength of at least 28 g/d and a tensile modulus of at least 700 g/d in a solvent and a dye for coloration, said dye being used at an amount below the solubility thereof in said solvent at the melting temperature of solvent-containing filaments which are obtained by spinning said solution of ultra-high molecular weight polyethylene;

(b) spinning said solution to form solvent-containing filaments; and (c) drawing said solvent-containing filaments to form a colored filament of ultra-high molecular weight polyethylene.

16. A process according to claim 15, wherein the viscosity-average molecular weight of said polyethylene is at least 500,000.

17. A process according to claim 16, wherein the viscosity-average molecular weight of said polyethylene is at least 1,000,000.

18. A process according to claim 15, wherein said colored filament of ultra-high molecular weight polyethylene has a tensile strength of at least 35 g/d and a tensile modulus of at least 1150 g/d.

19. A process according to claim 18, wherein said colored filament of ultra-high molecular weight polyethylene has a tensile strength of at least 40 g/d and a tensile modulus of at least 1250 g/d.

20. A process according to claim 15, wherein said dye is selected from the group consisting of solvent dyes and disperse dyes.

21. A process according to claim 20, wherein said dye is an anthraquinone derivative dye.

* * * * *